US006234840B1

(12) United States Patent
Nakata et al.

(10) Patent No.: US 6,234,840 B1
(45) Date of Patent: May 22, 2001

(54) SHIELD CONNECTOR

(75) Inventors: Naohisa Nakata; Tomokazu Shishikura, both of Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 09/421,407

(22) Filed: Oct. 21, 1999

(30) Foreign Application Priority Data

Oct. 21, 1998 (JP) ..... 10-299197

(51) Int. Cl.[7] ..... H01R 13/648
(52) U.S. Cl. ..... 439/607; 439/95
(58) Field of Search ..... 439/607–610, 439/108

(56) References Cited

U.S. PATENT DOCUMENTS

| | | | | |
|---|---|---|---|---|
| 4,650,270 | | 3/1987 | Tajima . | |
| 4,936,795 | * | 6/1990 | Kawai et al. | 439/609 |
| 4,981,447 | | 1/1991 | Ichitsubo . | |
| 4,983,127 | * | 1/1991 | Kawai et al. | 439/609 |
| 5,222,909 | * | 6/1993 | Nomma et al. | 439/610 |
| 5,791,939 | * | 8/1998 | Tamigawa | 439/610 |
| 5,797,770 | | 8/1998 | Whiteman, Jr. et al. . | |
| 6,045,390 | * | 4/2000 | Metz et al. | 439/610 |

FOREIGN PATENT DOCUMENTS

| | | |
|---|---|---|
| 0371218 | 6/1990 | (EP) . |
| 0608813 | 8/1994 | (EP) . |
| 0608863 | 8/1994 | (EP) . |
| 0827238 | 3/1998 | (EP) . |
| 2542233 | 4/1997 | (JP) . |

* cited by examiner

*Primary Examiner*—Hien Vu
(74) *Attorney, Agent, or Firm*—Kanesaka & Takeuchi

(57) ABSTRACT

A plug connector (A) comprises a connector housing (1A) having a plugging section (2) with an end face (6) having at least one contact (9) forming a connector body (1), left and right shields (19A, 19B) put into left and right shield insertion slots (12A, 12B), a linking piece (20) cut off to separate the left and right shields to mount a shield member (18) in the connector body.

3 Claims, 8 Drawing Sheets

SHIELD CONNECTOR

BACKGROUND OF THE INVENTION

1. Field of the Invention

The present invention relates to shield connectors for connecting shield cables of electronic equipment mounted on a vehicle or the like.

2. Description of the Related Art

Japanese UM patent No. 2542233 discloses a shield connector of this type. This connector socket comprises a socket housing with a terminal mounting section having a lance portion therein, a terminal unit mounted in the terminal mounting section for engagement with the lance portion, and a shield cover mounted on the socket housing.

However, the shield connector consists of three components; the socket housing, the terminal unit, and the shield cover. Especially, the terminal unit is mounted in the terminal mounting section for engagement with the lance portion which makes the socket housing bulky.

SUMMARY OF THE INVENTION

Accordingly, it is an object of the invention to provide a shield connector having no lance portion which enables to not only provide a small connector housing but also facilitate mounting the shield member to the connector body, thereby improving the assembling process.

It is another object of the invention to provide a shield connector which assures firm connection of not only the terminal unit but also the connectors.

According to one aspect of the invention there is provided a shield connector comprising a connector housing having a rear face and a front plugging section with an end face; at least one contact attached to said end face; first and second shield insertion slots provided in said rear face; a shield member having first and second shields and a linking piece for temporarily connecting said first and second shields, wherein said first and second shields are put into said first and second shield insertion slots, respectively, and said linking piece is cut off to separate said first and second shields thereby mounting said first and second shields in said connector housing.

At least one contact is provided on the end face of the plugging section and the first and second shields are put into the first and second shield insertion slots and, then, the linking piece is cut off to separate the first and second shields and mount the in the connector housing forming a shield connector.

Consequently, the number of parts is reduced and no lance is needed making possible not only minimizing the connector housing but also facilitating assembling of the shields into the connector housing.

According to another aspect of the invention, said first and second shield insertion slots have a C-shape in each half of said rear face, said first and second shield insertion being of line symmetry, said first and second shield insertion slots have at least one shield piece insertion aperture and at least one piece insertion slot in communication with said shield piece insertion aperture, and Said first and second shields have a C-shaped form and at least one front shield piece with a contact point and a rear shield terminal.

The first and second shields are put into the first and second shield insertion slots and shield pieces are put into the piece insertion slots, and the linking piece is cut off to separate and mount the first and second shields in the connector housing.

According to still another aspect of the invention there is provided a shield connector comprising a connector housing having a plugging section with an end face having a contact arranging portion to which at least one contact attached and at least one shield insertion slot provided a rear face of said connector housing for surrounding said contact; a first joint provided between said shield insertion slots and at least one second joint for connecting said end face to said connector housing; said first and second joint extend from said end face to said rear face and from said end face halfway to said rear face, wherein said first and second shields are inserted into said shield insertion slots to mount in said connector housing such that said first and second shields shield said contact.

At least one contact is provided on the end face of the plugging section, and the shields are put into the shield insertion slots to mount the shields in the connector housing, forming a shield connector.

Consequently, the number of parts is reduced and no lance is needed, making possible not only minimizing the connector housing but also facilitating mounting the shields in the connector housing.

The shield jacket of a mating connector shields a portion of the contact corresponding to the plugging section and the shields shield the other portion of the contact corresponding to the contact arranging section, thereby minimizing the connector housing in the plugging direction.

According to yet another aspect of the invention there is provided a shield connector comprising a connector body including a connector housing having a front terminal unit mounting section and a rear cable insertion section; a terminal unit including an insulating block with at least one contact connected to a core wire of a cable, a shield jacket for receiving said insulating block, a shield cover provided over said insulating block, said shield jacket having a bent shield section for engagement with said shield cover and said shield jacket having a crimping portion deformed on a shield of said cable; said terminal unit being put into said terminal unit mounting section from a side of said cable insertion section for engagement, said shield cable being put into said cable insertion section; a retainer provided over said cable insertion section for engagement with said connector housing to hold said terminal unit from back.

Upon connector plugging, the terminal unit is held by the retainer from back so that it is not pushed out of the connector housing by the contact of a mating connector, thus assuring connection between the connectors.

According to another aspect of the invention, said shield cover and said retainer are provided with a semi-circular flange, respectively, to surround said core wire of said shield cable.

The core wire of a shield cable is surrounded by the flanges of the cover and the retainer, thus providing improved shield effects.

DESCRIPTION OF THE PREFERRED EMBODIMENTS

Figure 1:
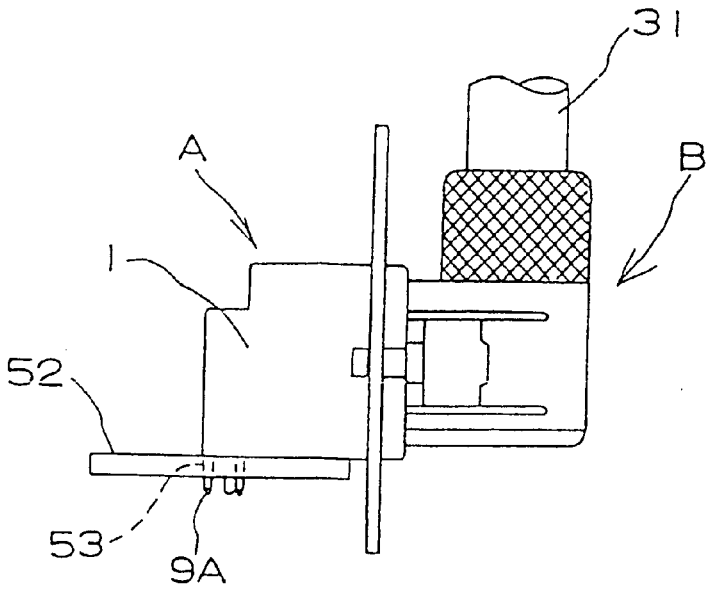
FIG. 1 is a side elevational view of a shield connector according to an embodiment of the invention wherein a plug connector is connected to a receptacle connector.
Figure 2:
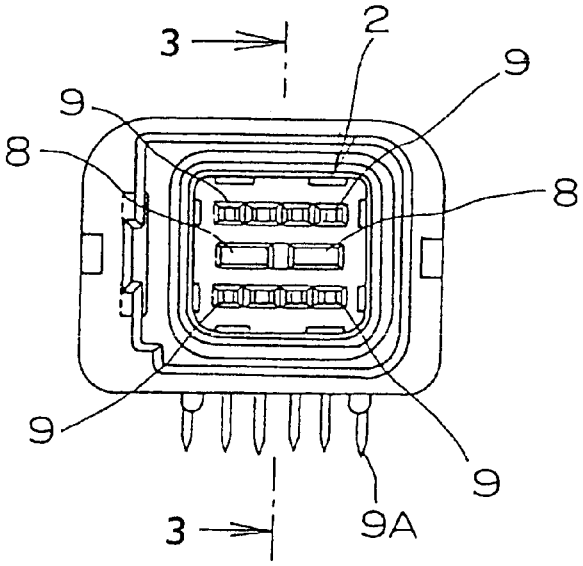
FIG. 2 is a front elevational view of the plug connector.
Figure 3:
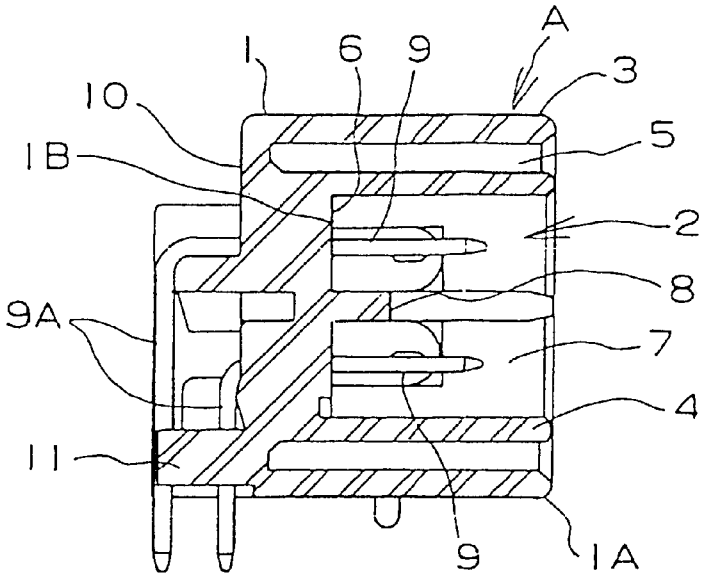
FIG. 3 is a sectional view taken along line 3—3 of FIG. 2.
Figure 4:
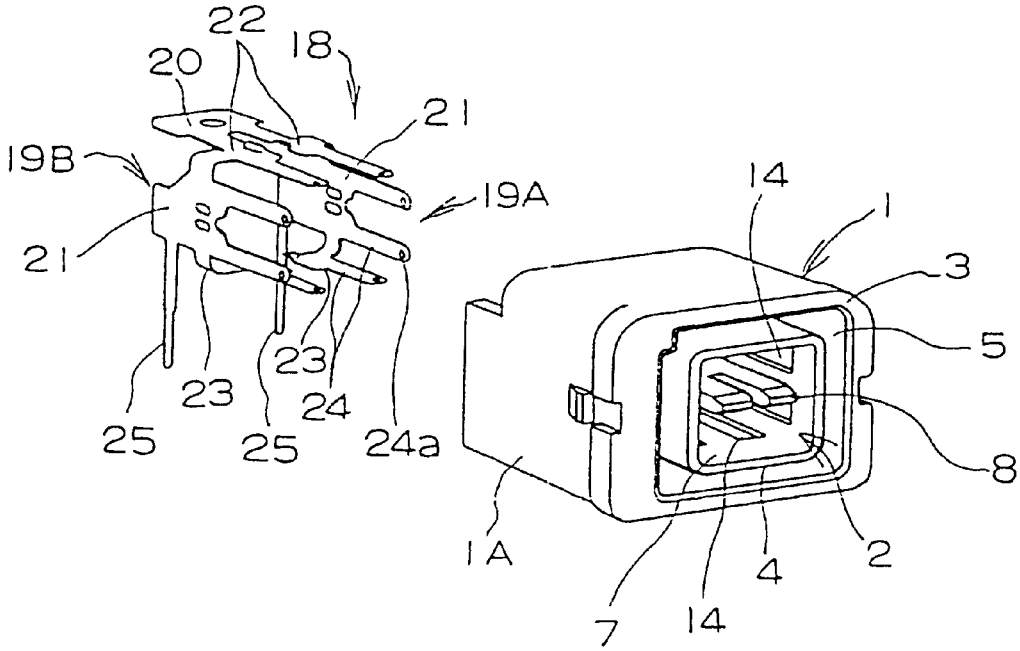
FIG. 4 is a front perspective view of the plug connector wherein a shield member is put into a connector housing.
Figure 5:
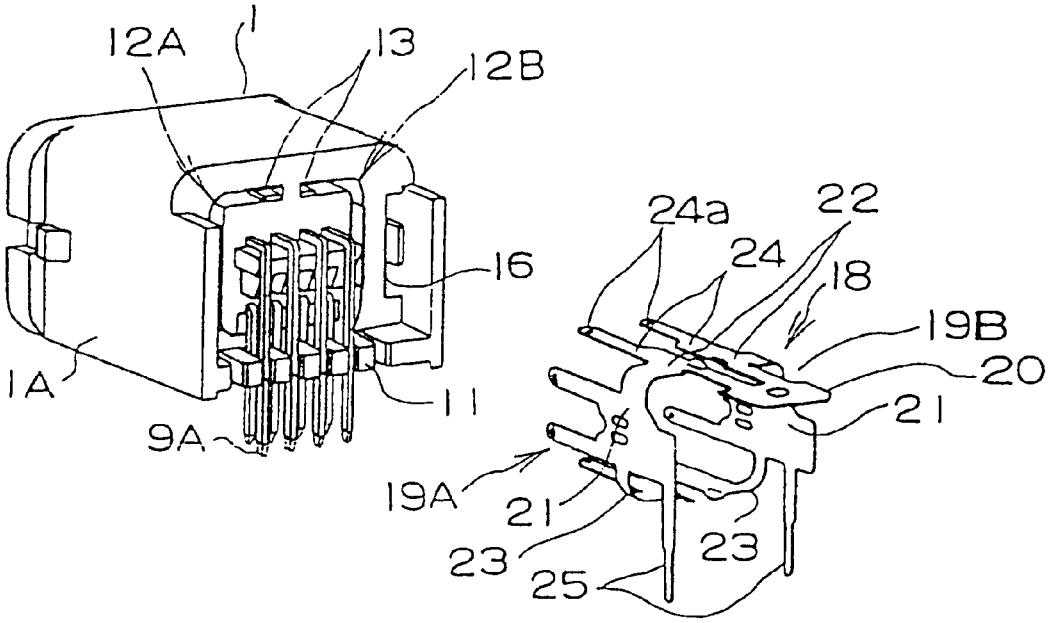
FIG. 5 is a rear perspective view of the plug connector wherein the shield member is put into the connector housing.

In FIG. 1, a shield connector consists of a plug connector A and a receptacle connector B. The plug connector A comprises a connector body 1 and a shield member 18 as shown in FIG. 4. The connector body 1 comprises a plugging section and a plurality of contacts 9 press-fitted into the plugging section as shown in FIG. 2.

In FIGS. 2–5, the connector housing 1A comprises a double wall plugging section 2 and an arranging section 1B for arranging contacts 9. The plugging section 2 consists of an outer plugging cavity 5 between a peripheral wall 3 and an inner wall 4 and an inner plugging cavity 7 defined by the inner wall 4 and an end wall 6 so that forceful plugging is prevented to protect the contacts 9.

A pair of projections 8 are provided at the center of the end wall 6 to prevent wrong forceful plugging for protecting the contacts 9. The contacts 9 are press-fitted to the end wall 6 in two rows above and below the projections 8 such that the leads 9A project rearwardly from the rear face 10 of the connector housing 1A. The leads 9A are bent at right angles and the end portions are supported by a locator 11 which extend laterally from the rear face 10.

The plugging section 2 and the arranging section 1B are molded integrally and joined at a pair of first joints 1C. The first joints 1C extend from the end face 6 to the rear face 10. In addition, there are four joints 1D which extend from the end face 6 halfway to the rear face 10. The portions of the contacts 9 corresponding to the plugging section 2 and the arranging section 1B are shielded by a shield jacket 39 (FIG. 13) and left and right shields 19A and 19B, respectively, thus reducing the length of the connector housing 1A in the plugging direction.

Figure 6:
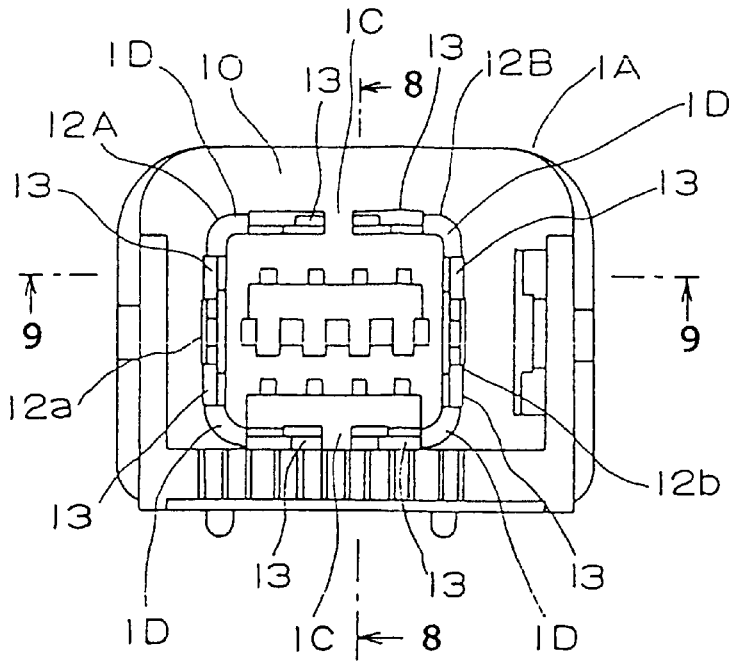
FIG. 6 is a rear elevational view of the connector housing.
Figure 7:
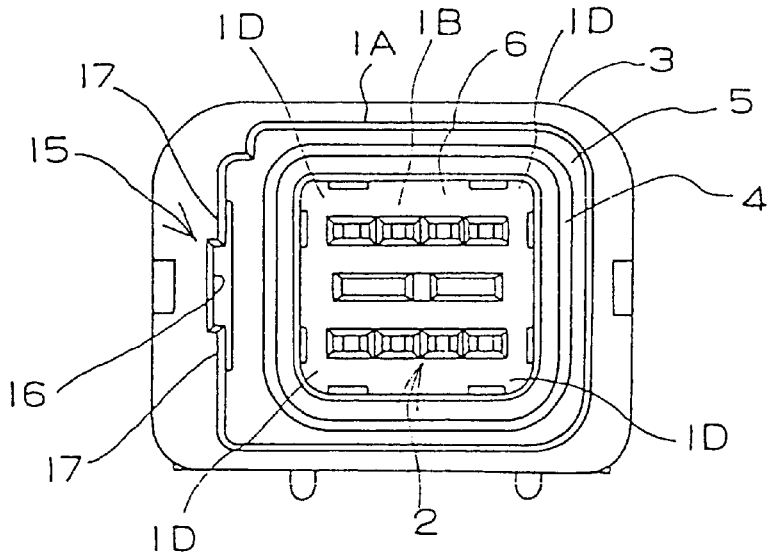
FIG. 7 is a front elevational view of the connector housing.

In FIGS. 6 and 7, left and right receiving slots 12B and 12A are provided in the rear face 10 of the connector housing 1A. The left and right receiving slots 12B and 12A have a C-shape provided in the left and right halves, respectively, of the rear face 10.

Figure 8:
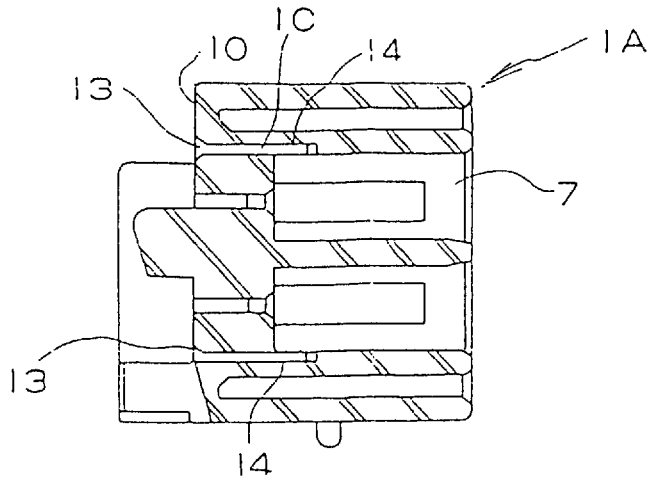
FIG. 8 is a sectional view taken along line 8—8 of FIG. 6.
Figure 9:
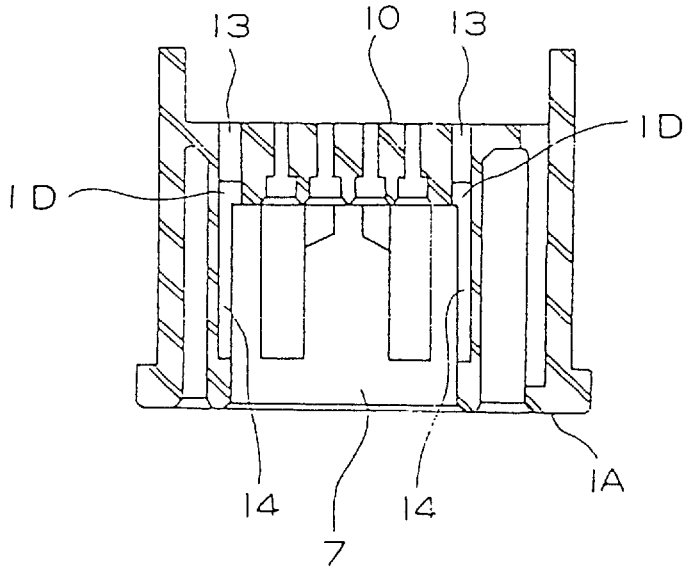
FIG. 9 is a sectional view taken along line 9—9 of FIG. 6.

In FIGS. 8 and 9, shield terminal insertion slots 13 and terminal insertion slots 14 are provided at the upper and lower portions of the left and right shield insertion slots 12B and 12A and above and below an intermediate portions 12*b* and 12*a*. The terminal insertion slots 14 receives shield contact pieces 24 such that they are brought into resilient contact with shield pieces 24 without abutting against a mating shield.

As shown in FIG. 7, a lock device 15 is provided at the outer plugging cavity 5 and comprises a lock recess 16 and a pair of engaging projections 17.

Figure 10:
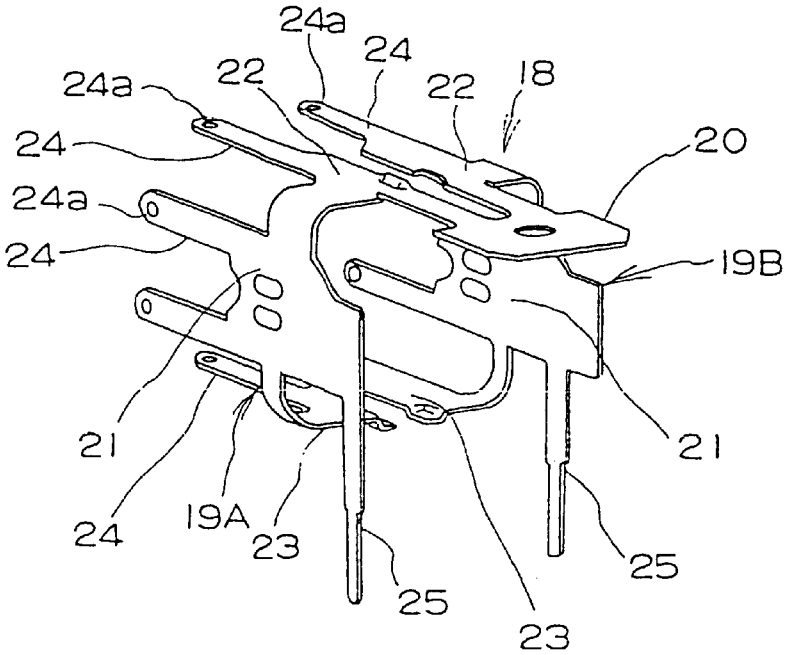
FIG. 10 is a front perspective view of the shield member.
Figure 11:
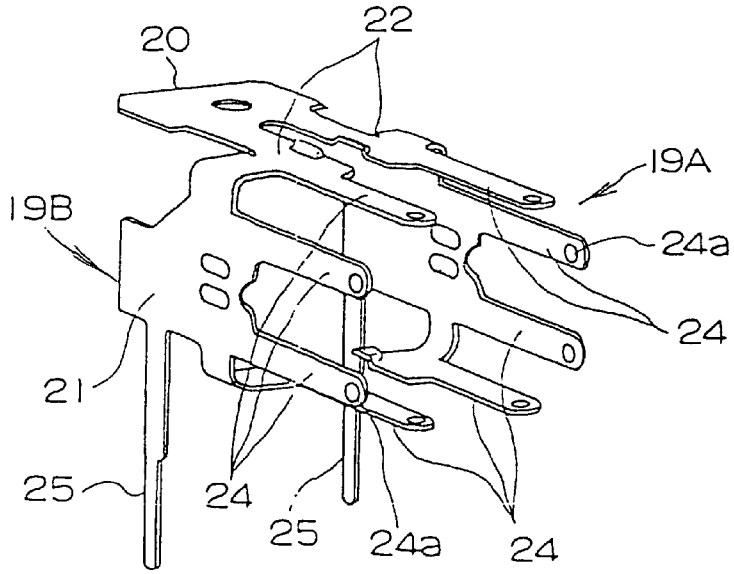
FIG. 11 is a rear perspective view of the shield member.

In FIGS. 10 and 11, the shield member 18 comprises left and right shields 19B and 19A and a linking piece 20 for temporarily connecting them. The left shield 19B has a side shield face 21 and upper and lower shield faces 22 and 23 provided at right angles with the side shield face 21. Shield pieces 24 extend forwardly from these shield faces 21, 22, and 23 and each have a contact point 24*a*. A fixing portion 21*a* is provided at a middle of the side shield face 21 while a shield terminal 25 extends downwardly from the rear edge of the side shield face 21.

The right shield 19A is a mirror image of the left shield 19B and the same or like components are provided with like reference numerals. The left and right shields 19B and 19A are temporarily linked by the linking piece 20 at the rear ends of the top shield faces 22.

By inserting the left and right shields 19B and 19A into the shield insertion slots 12B and 12A such that the shield pieces 24 enter piece insertion slots 14. Then, the linking piece 20 is cut off to separate the right and left shields 19B and 19A so that the shield member 18 is mounted in the connector housing 1A. The left and right shields 19B and 19A are so flexible that the shield pieces 24 are placed at correct positions automatically.

Figure 12:
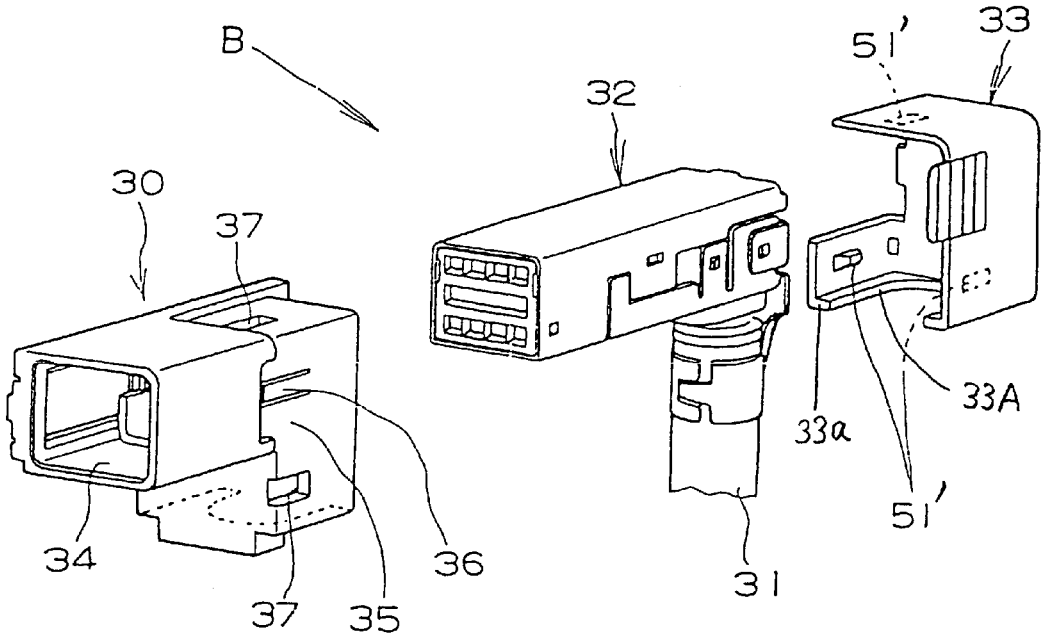
FIG. 12 is an exploded perspective view of the receptacle connector.

As shown in FIGS. 1 and 12, the receptacle connector B comprises a connector housing 30, a terminal unit 32 connected to the shield cable 31, and a retainer 33.

In FIG. 12, the connector housing 30 has a terminal unit mounting cavity 34 at the front end and a cable insertion section 35 at the rear end. The upper portion of the cable insertion section 35 communicates with the terminal unit mounting cavity 34. Lance portions 36 are provided at the left and right walls of the cable insertion section 35, and engaging holes 37 are provided below and above the lance portions 36. A lock device (not shown) is provided on the connector housing 30 and comprises a lock lever and engaging projections on the lock lever.

Figure 13:
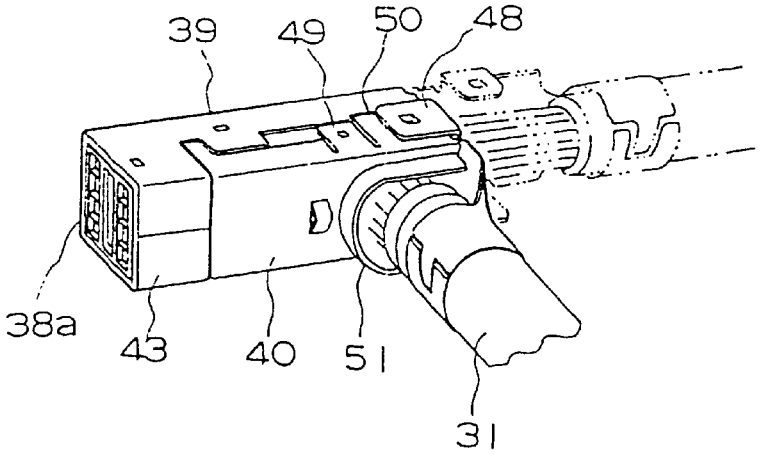
FIG. 13 is a perspective view of a terminal unit for the receptacle connector.
Figure 14:
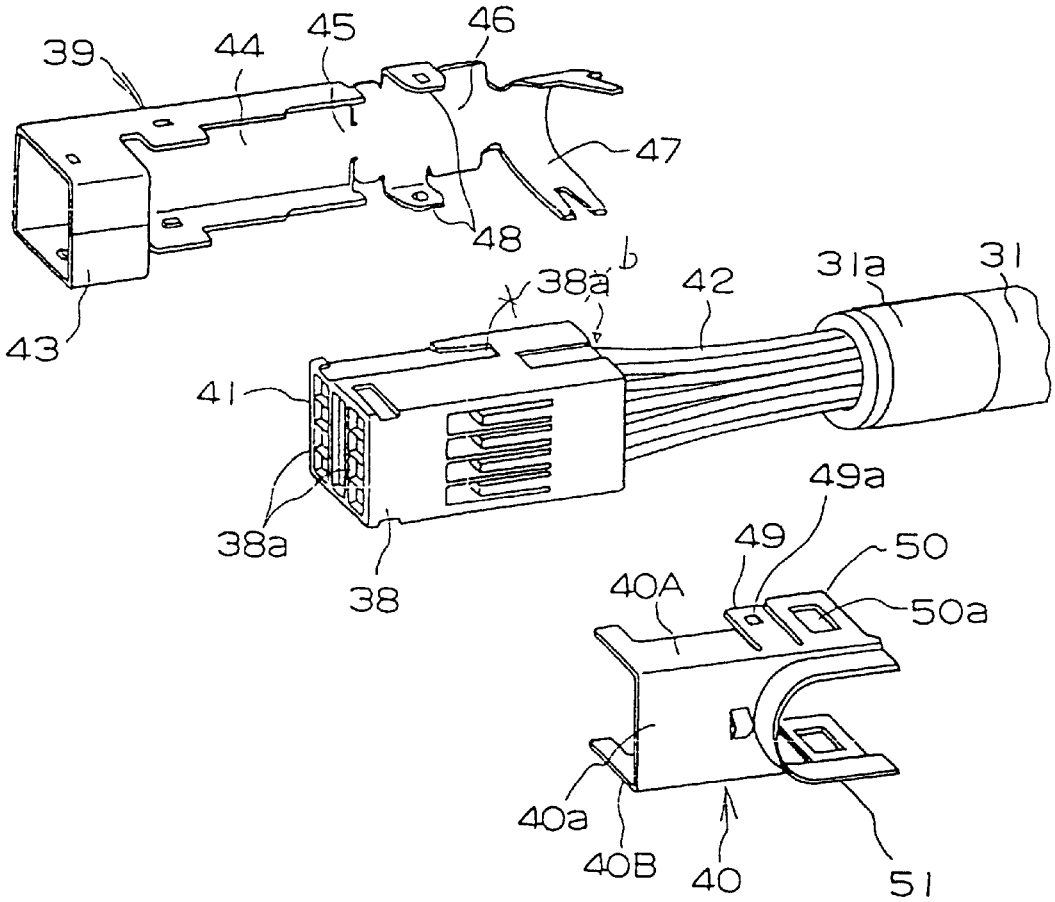
FIG. 14 is an exploded perspective view of the terminal unit.

In FIGS. 13 and 14, the terminal unit 32 comprises an insulating block 38 with contact mounting apertures 38*a*, a shield jacket 39, a shield cover 40, and contacts 41 which are connected to core wires 42 of a shield cable 31. The contacts 41 are mounted in the contact mounting apertures 38*a*.

The shield jacket 39 has a shield tubular section 43, a cover section 44, a bending portion 45, a bent shield section 46 with engaging pieces 48, and a crimping section 47. The shield cover 40 has a semi-circular flange 51 at the end of a bottom face 40*a* and engaging pieces 49 and 50 provided on the left and right side walls 40A and 40B.

The insulating block 38 is inserted into the shield jacket 39, and the shield cover 40 is put over the insulating block 38 such that the engaging projections 49*a* of the shield cover 40 engage the engaging recesses 38*b* of the left and right sides of the insulating block 38. The bendable (bent) shield section 46 and the shield cable 31 are bent at the bending portion 45 at right angles with the insulating block 38 such that the engaging portions 48 engage the engaging holes 50*a* of the shield cover 40. Then, the crimping section 47 of the shield jacket 39 is crimped to the shield 31*a* of the shield cable 31.

As shown in FIG. 12, the retainer 33 has a form of a cap and has engaging projections 51 on the left and right and left inside walls and a semi-circular retainer flange 33A at the bottom face 33*a*. The terminal unit 32 is inserted into the terminal unit mounting section 34 from the side of the cable insertion section 35 for engagement with the lance portions 36 while the shield cable 31 lies adjacent the cable insertion section 35. At this point, the retainer 33 is put over the cable insertion section 35 such that the engaging projections 51 of the retainer 33 engage the engaging holes 37 so that the retainer 33 holds the terminal unit 32 from back while the flanges 51 and 33A surround the core wire 44 of the shield cable 31, thereby enhancing the shield effect on the core wire 44 of the cable 31.

As shown in FIG. 1, the plug connector A is mounted on a printed circuit board 52 by inserting and soldering the leads 9A of the contacts 9 to the through-holes 53 of the PCB 52. The connector housing 30 and the terminal unit 32 of the receptacle connector B are plugged into the outer plugging cavity 5 and the inner plugging cavity 7 of the plug connector A, respectively, such that the lock device of the receptacle B engages the lock device 15 of the plug connector A to connect the receptacle connector B to the plug connector A.

Under this condition, the contacts 41 of the receptacle connector B are brought into contact with the contacts 9 of the plug connector A while the shield jacket 39 of the terminal unit 32 is brought into contact with the contact points 24*a* of the shield member 18.

In the above embodiment, the contacts 9 are provided on the end face 6 of the plugging section 2, and the left and right shields 19B and 19A are inserted into the left and right shield insertion slots 12B and 12B, respectively. Then, the linking piece 20 is cut off to separate the left and right shields 19B and 19A such that the shield member 18 is attached to the connector body 1 to provide a shield connector. Consequently, the number of parts is reduced, and no lance is necessary, thus minimizing the connector housing 1A.

The left and right shields 19B and 19A of the shield member 18 are put into the shield insertion slots 12B and 12A such that the shield pieces 24 are inserted into the piece insertion slots 14 through the shield piece insertion aperture 13 and the linking piece 20 is cut off to separate the left and right shields 19B and 19A so that the shield member 18 can be mounted in the connector body 1, thus facilitating mounting the shield member 18 to the connector body 1 and the assembling operation.

The terminal unit 32 is put into the terminal unit mounting section 34 from the side of the cable insertion section 35 for engagement while the shield cable 31 is put into the cable insertion section 35 and the retainer 33 is put over the cable insertion section 35 for engagement with the connector housing 30 to hold the terminal unit 31 from back so that when the plug and receptacle connectors A and B are connected, the terminal unit 31 is not dropped off from the connector housing 30 by the contacts 9 of the plug connector A, thus assuring the plugging of the connectors.

As has been described above, the shield connector according to the invention comprising a connector housing with an end face of a plugging section having contacts and shields put into first and second shield insertion slots and the linking member is cut off to separate the first and second shields to mount the shield members in the connector housing, forming a shield connector. Consequently, the number of parts is reduced and no lance is required, thus not only minimizing the connector housing but also facilitating mounting the shield member in the connector housing and thus the assembling process.

Since the area of the contact corresponding to the contact arranging section is shielded, the length of the connector housing in the plugging direction is minimized. Since the terminal unit is held by the retainer from back, it will not come out of the connector housing, thus assuring connection between the connectors. The semi-circular flanges are provided on the shield cover and the retainer, respectively, to surround the core wire of the shield cable, thus providing improved shield effects.

What is claimed is:

1. A shield electric connector comprising:

a connector housing having a front terminal unit mounting section and a rear cable insertion section having a lance portion;

a terminal unit including an insulation block with at least one contact connected to a core wire of a shield cable, a shield jacket for receiving said insulating block, and a shield cover provided over said insulating block, said shield jacket having a bent shield section and a crimping portion crimped on said shield cable;

said bent shield section holding the shield cable and being bent substantially at right angles with the shield cable to engage with said shield cover;

said terminal unit being inserted into said front terminal unit mounting section from a side of said rear cable insertion section for engagement with said lance portion of said rear cable insertion section, while said shield cable lies along said rear cable insertion section;

a retainer covering said rear cable insertion section and engaging with said connector housing to hold said terminal unit in said connector housing, said shield cover and said retainer provided with a semi-circular flange, respectively, to surround said core wire of said shield cable.

2. A shield electric connector comprising:

a connector housing having a rear face and a plugging section with an end face and a contact arranging section between said rear face and said end face;

at least one contact attached to said contact arranging section and extending outwardly from said rear face;

left and right shield insertion slots extending from said rear face to said end face for surrounding said contact arranging section;

at least one first joint provided between said left and right shield insertion slots and extending from said end face to said rear face;

at least one second joint extending from said end face halfway to said rear face; and a shield member having left and right shields each including a shield side face and inserted into said shield insertion slots to be mounted in said connector housing such that said left and right shields shield said at least one contact, wherein said shield member has a linking piece extending rearwardly from said shield member which temporarily connects said left and right shields and is cut off to separate said left and right shields after said left and right shields are inserted into said left and right shield insertion slots, respectively, thereby mounting said left and right shields in said connector housing, wherein each said shield side face has an electrical terminal extending downwardly from a rear edge thereof.

3. A shield electric connector according to claim 2, wherein said left and right shield insertion slots have a C-shape in each half of said rear face.

* * * * *